United States Patent [19]

Shimoda

[11] 3,932,910

[45] Jan. 20, 1976

[54] TONER CLEANING APPARATUS IN ELECTROPHOTOGRAPHIC COPYING MACHINE

[75] Inventor: Kazuho Shimoda, Hachioji, Japan

[73] Assignee: Konishiroku Photo Industry Co., Ltd., Tokyo, Japan

[22] Filed: Sept. 10, 1974

[21] Appl. No.: 504,713

[30] Foreign Application Priority Data

Sept. 10, 1973 Japan ..... 48-101222

[52] U.S. Cl. ..... 15/301; 15/256.52; 55/368; 55/DIG. 29; 355/15

[51] Int. Cl.[2] ..... G03G 15/00

[58] Field of Search ..... 15/1.5, 301, 256.52, 347, 15/350, 308, 349, 352, 353, 383; 355/15; 55/DIG. 2, DIG. 3, DIG. 29, 368, 467; 101/425

[56] References Cited

UNITED STATES PATENTS 3,795,025 3/1974 Sadamitsu ..... 15/256.52

*Primary Examiner*—Edward L. Roberts

*Attorney, Agent, or Firm*—Jordan B. Bierman; Linda G. Bierman; Kenneth J. Stempler

[57] ABSTRACT

An improved cleaning apparatus for an electrophotographic copying device which comprises (a) a cleaning brush, (b) a casing for said brush having a front end portion which forms a first opening and a rear end portion which forms a second opening adapted to pass a toner therethrough, said brush within said casing and positioned adjacent said first opening so as to be adapted to contact a work surface, (c) a filter bag having a rim which forms an opening adapted to pass toner therethrough and which substantially overlaps said rear end portion, whereby a gap is formed between said rear end portion and said rim, and (d) means for suction of toner-containing air through said filter bag.

2 Claims, 2 Drawing Figures

TONER CLEANING APPARATUS IN ELECTROPHOTOGRAPHIC COPYING MACHINE

BACKGROUND OF THE INVENTION

The present invention relates to a toner cleaning apparatus in an electrophotographic copying machine. As is well known, such copying machines using an electrophotosensitive plate repeatedly, are provided with a cleaning station for removing toner powders electrostatically adhering on a surface of the photosensitive plate subsequent to charging, high-exposure, development and transfer. The cleaning station usually comprises a cleaning brush, a casing holding the cleaning brush, a filter bag, a duct whose one end is connected to the casing and whose other end is connected to the filter bag, and a suction means. In the conventional cleaning apparatus, an attachment member is provided at a connecting end of the casing or duct (hereinafter referred to simply as connecting end) and the rim of the filter bag is inserted into the attachment member. Alternatively, the rim of the filter bag is arranged so as to abut tightly against one end face of the duct. Under these conditions, toner powders tend to adhere to the rim or inlet portion of the filter bag with the result that upon detaching the filter bag, these toner powders scatter and stain the apparatus, or the clothes and hands of the operator.

SUMMARY OF THE INVENTION

According to the present invention, this object is accomplished by the cleaning apparatus which comprises a cleaning brush, a casing for said brush having an end portion which forms an opening to pass toner, a filter bag having a rim which substantially overlaps said end portion thereby forming a space between said end portion and said rim, and means for sucking the toner-containing air through said filter bag.

DESCRIPTION OF PREFERRED EMBODIMENT

Figure 1:
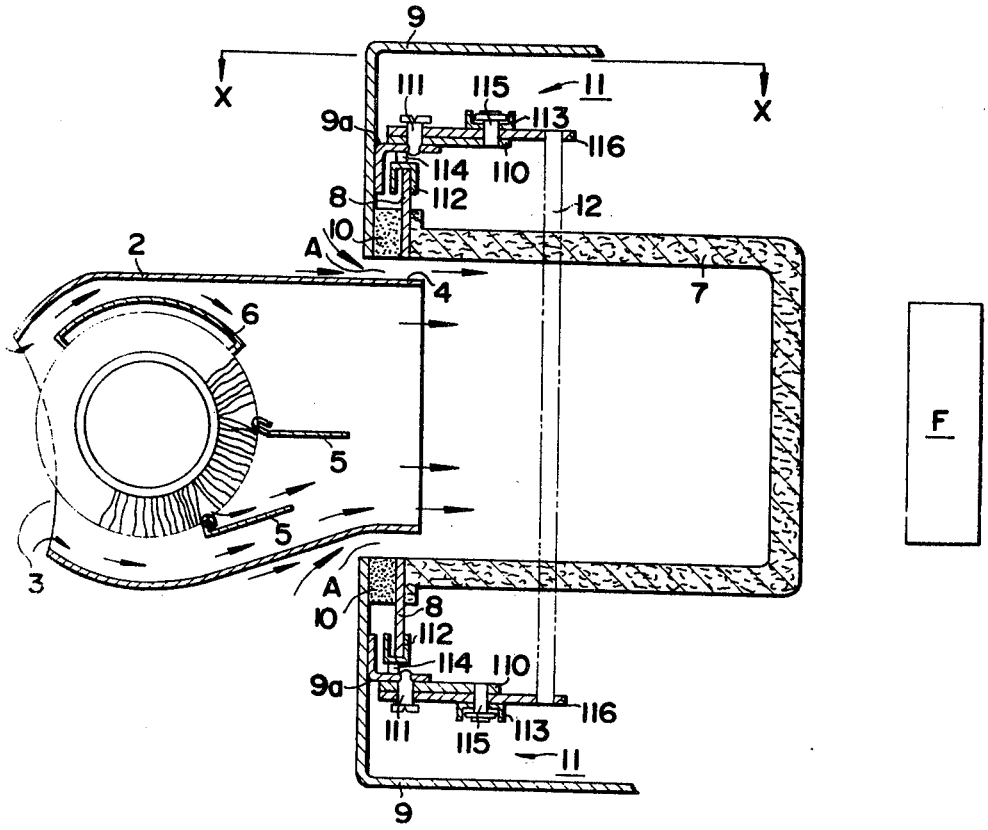
FIG. 1 is a vertical sectional view of one embodiment of this invention.

In FIG. 1, cleaning brush 1 is provided for cleaning off toner from a photosensitive plate (not shown); the brush comprising, for example, soft fur or soft synthetic fiber affixed to the surface of a paper core. Brush casing 2 covers brush 1. Opening portion 3, formed at front end of casing 2, exposes a portion of brush 1. Rear end 4 of casing 2 projects into a filter bag covering frame 9 as described herinafter.

Duster plates 5 are arranged so as to interfere with the brush 1 and thus serve to dust away—by the relative impact force between the brush and the duster plate—toner adhering in the brush. Plate 6 is provided for introducing air into the casing without being disturbed by the air stream generated by rotation of the brush 1, the plate having an arc configuration over a wide range. Filter bag 7 is formed of, for example, glass fibers and an opening portion of the filter bag 7 is arranged so as to overlap with the outer periphery of the casing rear end 4 leaving a predetermined gap A. Hollow cylindrical rim 8 is secured to the filter bag opening portion and covering frame 9 which has an opening in the front face thereof of a size at least equal to the filter bag opening and to which a base plate 9*a* is fixed. Thick and hollow cylindrical packing 10 is secured to the covering frame 9 and a toner suction means F (hereinafter referred to simply as suction means) is arranged behind the filter bag.

In such an arrangement, as the suction means F is energized, air of the filter bag and within brush casing 2 is sucked to the right. In this case, since the pressure within the filter bag 7 and the casing 2 is decreased, air flows therein from the opening portion 3 of the casing 2, thereby generating a first air stream. When the brush 1 rotates and wipes toner on the photosensitive plate (not shown) and the duster plates 5 dust away toner adhering on the brush 1, the toner powders are accumulated in the filter bag 7 along the first air stream. At this time, the suction also acts on the gap A between the outer periphery of the casing rear end 4 and the filter bag opening, thereby generating a second air stream in the gap to prevent the toner from adhering near the inlet portion of the filter bag 7. By such an arrangement, adhesion of the toner to the rim 8 and the inlet portion of the filter bag 7 is completely prevented, so that when the filter bag 7 is detached from the plate 9, scattering of the toner does not occur. In the preferred embodiment of the present invention, the deenergization of the suction means F is delayed slightly in beyond the stopping of the rotation of the brush 1.

Thus, scattering of the toner due to premature stopping of the suction means is completely prevented without the provision of any additional device. Though in the above-described embodiment, the casing rear end 4 and the rim 8 have been positioned in an overlapping relationship, similar effects may be obtained if rim 8 of the filter bag 7 face approximately aligns whith the face of the rear end 4 of the casing. Link mechanisms 11 are used for the attachment and detachment of the filter bag 7. The identical link mechanisms are synmetrically arranged above and below the filter bag 7 and are constructed so as to be operated simultaneously by a handle 12.

Figure 2:
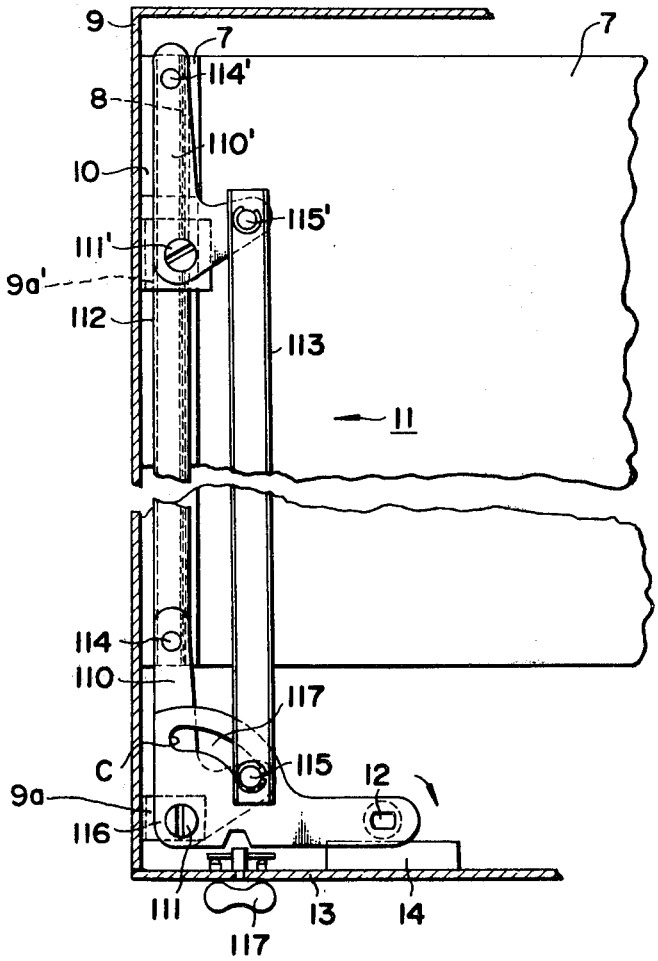
FIG. 2 is a sectional view along a line X — X of FIG. 1.

FIG. 2 shows a view viewed along arrows X —X of FIG. 1. In FIG. 2, numerals 110 and 110′ designate right and left, paired L-shaped levers which are rotatably supported on the base plate 9*a* by pivots 111 and 111′, respectively which are secured to the filter bag covering frame 9. Guide 112 has a U-shaped cross section and supports rim 8 of the filter bag. Both ends of guide 112 are rotatably coupled through pins 114 and 114′ to the respective one-side arms of the pair of levers 110 and 110′. Interlocking link 113 connects the pair of the levers 110 and 110′ for the parallel displacement of the guide 112, and is rotatably coupled to the respective other-side arms of the levers 110 and 110′.

Lever 116 is sandwiched between the lever 110 and the interlocking link 113 and rotatably mounted at pivot 111. The lever 116 has a arc-shaped slot 117. A pin 115 intrudes into the slot 117 so that when the lever 116 rotates clockwise through a given angle, lever 116 does not interfere with the pin 115, but when the lever 116 has rotated beyond the given angle, the pin 115 is rotated about the pivot 111 by the lever 116, thereby causing the pair of levers 110 and 110′ to rotate clockwise through the interlocking link 113. Handle 12 connects the end of the lever 116 mounted over the filter bag 7 of said link mechanism with one end of the lever 116 mounted under the filterbag 7 of the other link mechanism. Door 13 is formed in a portion of the covering frame 9. Knob 117 is actuated to open the door 13. packing 14 is secured to the inner side of the door and has such thickness that the packing abuts handle 12 when the door is closed.

When the filter bag is detached, opening the door 13 and rotating the handle 12 in a direction shown by the arrow in FIG. 2 causes the rotation of lever 116. After the lever 116 has been rotated through the given angle, and the end C of the arc-shaped slot abuts pin 115, the levers 110 and 110' are interlocked. Therefore, the guide 112 and the interlocking link 113 coupled to the respective arms of the lever 110 and 110' gradually move in parallel. In FIG. 1, the rim 8 of the filter bag moves toward the right and is released from the rear end 4 of the casing 2. The detachment of the filter bag can be easily achieved by grasping and drawing out the rim 8 of the filter bag after the handle 12 has been rotated until rim 8 no longer overlaps the release end of the casing 2.

In one embodiment of the present invention, a gap A is formed on the entire region aroung the rear end portion 4 of the casing 2. However, in another embodiment of the present invention, the gap A may be formed on the lower half of the region because the toner tends to adhere to the lower half of the rim 8 or the inlet portion of the filter bag due to gravity.

What is claimed is:

1. An improved cleaning apparatus for an electrophotographic copying device which comprises (a) a cleaning brush, (b) a casing for said brush having a front end portion which forms a first opening and a rear end portion which forms a second opening adapted to pass a toner therethrough, said brush within said casing and positioned adjacent said first opening so as to be adapted to contact a work surface, (c) a filter bag having a rim which forms an opening adapted to pass toner therethrough and which substantially overlaps said rear end portion, said filter bag opening being substantially larger than said second opening whereby a gap is formed between said rear end portion and said rim, and (d) means for producing suction through said casing into and through said filter bag to carry toner-containing air.

2. A cleaning apparatus in electrophotographic copying machine according to claim 1 further comprising means for moving said filterbag from a first position in which said rear end portion of said casing and said rim of said filterbag overlap with each other to a second position in which said rear end portion and said rim are out of overlap-relationship.

* * * * *